US010716981B1

(12) United States Patent
Biafore, Jr.

(10) Patent No.: US 10,716,981 B1
(45) Date of Patent: Jul. 21, 2020

(54) PUTTER GRIP

(71) Applicant: SSG International, LLC, Wixom, MI (US)

(72) Inventor: John J. Biafore, Jr., Grand Blanc, MI (US)

(73) Assignee: SSG International, LLC, Wixom, MI (US)

( * ) Notice: Subject to any disclaimer, the term of this patent is extended or adjusted under 35 U.S.C. 154(b) by 0 days.

(21) Appl. No.: 16/376,722

(22) Filed: Apr. 5, 2019

(51) Int. Cl.
*A63B 53/14* (2015.01)
*A63B 53/00* (2015.01)
*A63B 60/06* (2015.01)

(52) U.S. Cl.
CPC ..... *A63B 53/14* (2013.01); *A63B 53/007* (2013.01); *A63B 60/06* (2015.10)

(58) Field of Classification Search
CPC ..... A63B 53/14; A63B 53/007; A63B 60/06
See application file for complete search history.

(56) References Cited

U.S. PATENT DOCUMENTS 4,067,573 A * 1/1978 Key, Jr. ..... A63B 53/14 473/201
5,398,930 A * 3/1995 Gibson ..... A63B 53/14 473/201
5,749,792 A * 5/1998 Engfer ..... A63B 53/14 473/300
5,813,920 A * 9/1998 Rife ..... A63B 60/14 473/300
6,902,492 B1 * 6/2005 Strand ..... A63B 53/14 473/201
8,317,634 B2 * 11/2012 Hachiro ..... A63B 53/14 473/300
8,932,145 B2 * 1/2015 Hachiro ..... A63B 60/48 473/300
9,700,772 B2 * 7/2017 Goldfader ..... A63B 53/14
10,046,213 B2 * 8/2018 Goldfader ..... A63B 53/14
10,500,455 B1 * 12/2019 Cavill ..... A63B 53/007
2004/0259660 A1 * 12/2004 Zichmanis ..... A63B 53/14 473/300

* cited by examiner

*Primary Examiner* — Stephen L Blau
(74) *Attorney, Agent, or Firm* — Warner, Norcross + Judd LLP

(57) ABSTRACT

An improved putter grip is provided. In one embodiment, the putter grip includes opposing sloped sidewalls, such that the upper portion of the putter grip includes a dual-sided pistol configuration. The sloped sidewalls can be substantially planar, and the putter grip is symmetrical about a plane of symmetry that runs through the grip centerline. The opposing sloped sidewalls can be aligned in the fore-to-aft direction or aligned in the side-to-side direction and may be used by both a left-hand-dominant and a right-hand-dominant golfer without mechanical adjustment. The lower portion of the putter grip is a continuous extension of the upper portion but lacks the taper found in the upper portion of the putter grip. Embodiments also include a putter grip having only a single-sided taper that reduces to a minimum front-to-back width at an intermediate portion of the putter grip, the putter grip being symmetrical about the grip centerline.

12 Claims, 17 Drawing Sheets

PUTTER GRIP

FIELD OF THE INVENTION

The present invention generally relates to golf club grips and, more specifically, to putter grips.

BACKGROUND OF THE INVENTION

Various styles of golf club grips are known in the art. Several known golf club grips are intended to facilitate a particular form of swing by a user. However, such grips are restricted with respect to the orientation of the golf club head, do not facilitate square shoulder alignment during execution of a swing, or fail to be ambidextrous without mechanical adjustment.

Known golf club grips suffer at least the above limitations; therefore, there exists a need for a golf club grip that can help facilitate square shoulder alignment during execution of a golf swing by both left-hand-dominant and right-hand-dominant golfers without the need for mechanical adjustment. Further, there exists a need for a golf club grip that may be assembled in a plurality of orientations with respect to a club head without compromising functionality.

SUMMARY OF THE INVENTION

An improved putter grip is provided. In one embodiment, the putter grip includes opposing sloped sidewalls, such that the upper portion of the putter grip includes a dual-sided pistol configuration. The sloped sidewalls are substantially planar, and the putter grip is symmetrical about a plane of symmetry that runs through the grip centerline. The opposing sloped sidewalls can be aligned in the fore-to-aft direction or aligned in the side-to-side direction. The lower portion of the putter grip is a continuous extension of the upper portion of the putter grip but lacks the taper found in the upper portion of the putter grip.

In one embodiment, the sloped planar sidewalls comprise a left-facing surface and right-facing surface. The left-facing surface and the right-facing surface are joined to a front-facing surface and a rear-facing surface. The front-facing surface is generally planar along its entire length and is sufficiently wide to function as a point of engagement for left and right thumbs. The rear-facing surface runs parallel to the front-facing surface and is planar in some embodiments, while in other embodiments the rear surface is outwardly convex to provide a raised point of contact for one's fingers.

In other embodiments, the sloped sidewalls comprise the front-facing surface and the rear-facing surface, such that the sloped sidewalls are aligned with the toe and the heel of the putter head. The putter grip of the current embodiments can be installed as a stock grip or as a replacement grip for left- and right-handed putters. The centerline axis of the putter grip generally coincides with the axis of the putter shaft, and the cross-section remains generally similar throughout the length of the putter grip. The putter grip generally includes a rigid underlisting surrounded by a soft gripping surface, optionally a molded EVA sleeve with the desired texturing.

As described further below, the putter grip of the current embodiments helps maintain square shoulders while using a golf club to which the putter grip has been assembled. Depending on individual preferences, the putter grip can be oriented such that the sloped sidewalls are aligned in the fore-to-aft direction (i.e., the heel-to-toe direction of the putter head) or aligned in the side-to-side direction (i.e., aligned with the putter's striking face). Accordingly, the golf club is versatile such that the putter grip may be joined to a putter in multiple configurations without compromising function. Moreover, the putter grip may be used by both a left-hand-dominant and a right-hand-dominant golfer without any need for mechanical adjustment.

In still other embodiments, a putter grip including single-sided taper is provided. The putter grip according to this embodiment includes a rear-facing surface that includes a taper in an upper portion of the putter grip. The rear-facing surface begins at a maximum width and slopes forward until reaching an intermediate point along the putter grip, such that a lower portion of the putter grip includes a planar rear-facing surface that is parallel to a planar front-facing surface. The left- and right-side surfaces are parallel to each other along the entire length of the putter grip and interconnect the rear-facing surface and the front-facing surface. Further optionally, the rear-facing surface includes a vertex that extends along all or a portion of the putter grip, for example only in the upper portion of the putter grip.

These and other features and advantages of the present disclosure will become apparent from the following description of particular embodiments, when viewed in accordance with the accompanying drawings and appended claims.

DETAILED DESCRIPTION OF THE CURRENT EMBODIMENTS

Figure 1:
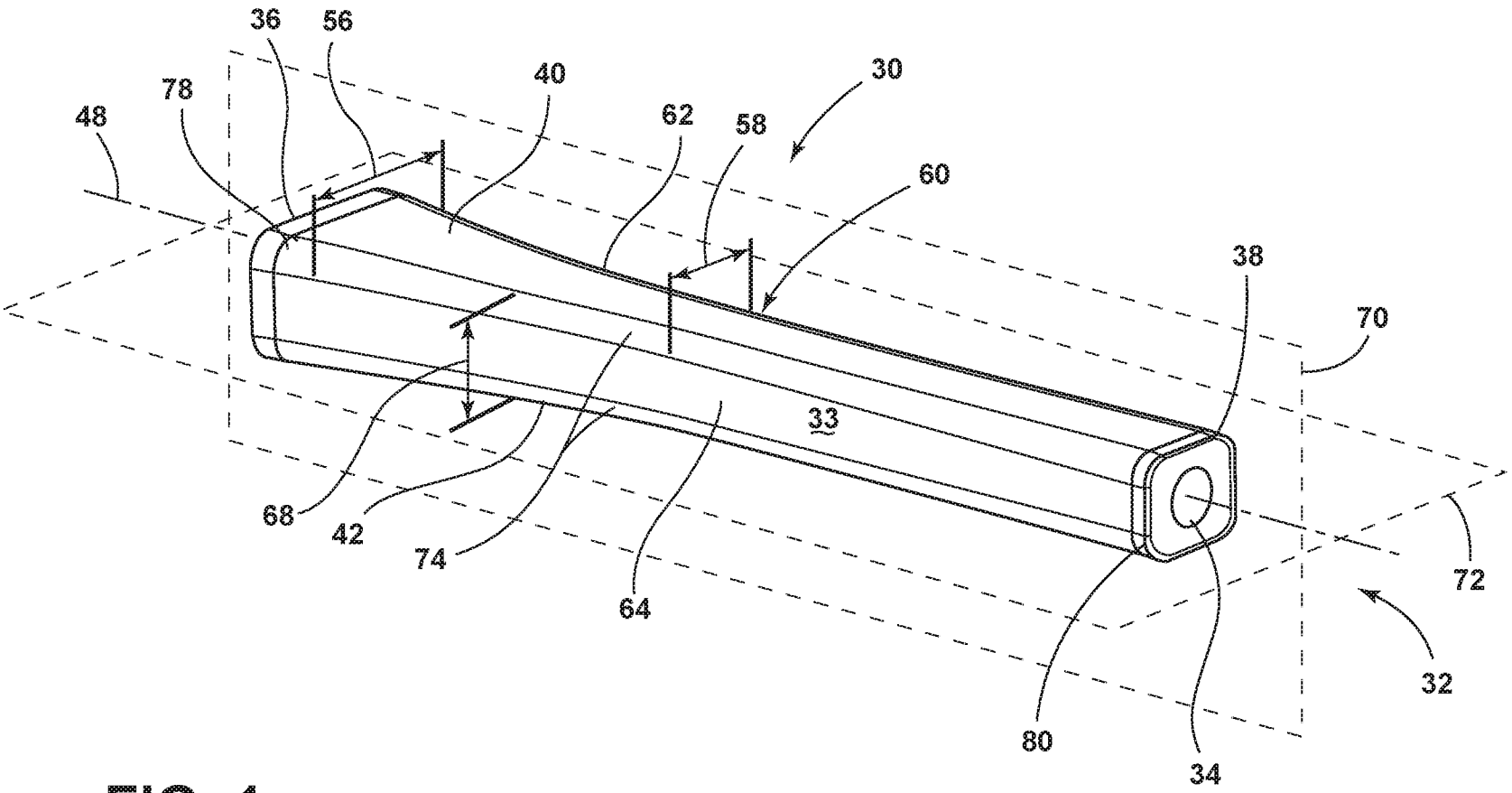
FIG. 1 is a perspective view of a first embodiment of a putter grip.
Figure 2:
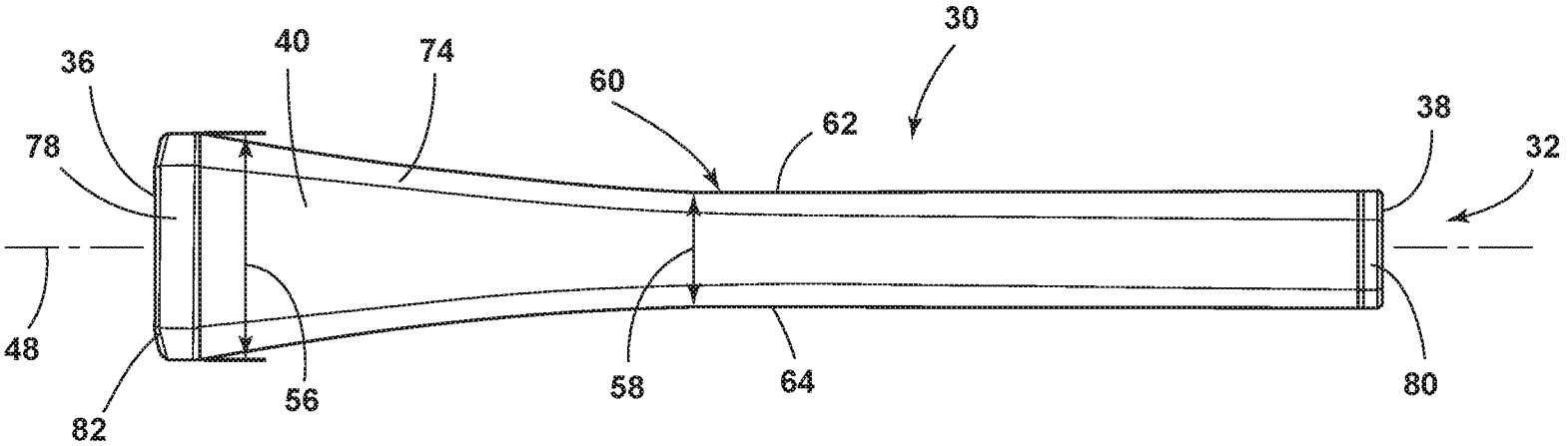
FIG. 2 is a first plan view of the putter grip of FIG. 1.

Referring to FIGS. 1-7, a putter grip in accordance with a first embodiment is illustrated and generally designated 30. The putter grip 30 generally includes a dual-sided pistol configuration having a uniform cross-sectional shape throughout its length. In particular, the putter grip 30 includes an elongated handle 32. The elongated handle 32 has an upper end 36, a lower end 38, a front-facing surface 40, and rear-facing surface 42. Optionally, the front-facing surface 40 and the rear-facing surface 42 are planar and fully mirror each other. Depending on the orientation of the putter grip 30, these surfaces 40, 42 may be oriented in the left-to-right direction, but for consistency, they are termed "front-facing surface" and "rear-facing surface" herein.

As shown in FIG. 1, the elongated handle 32 transitions from a maximum width 56 at the upper end 36 to a minimum width 58 at an intermediate point 60 along the putter grip 30. The intermediate point 60 is optionally mid-way between the upper end 36 and the lower end 38. Alternatively, the intermediate point 60 can be nearer to the upper end 36 or can be nearer to the lower end 38. The elongated handle 32 also includes a first side surface 62 and a second side surface 64. The first side surface 62 and the second side surface 64 slope toward each other along the longitudinal axis 48 of the elongated handle 32 such that a distance between the first side surface 62 and the second side surface 64 is at a maximum at the upper end 36 and decreases in a continuous manner with constant slope. In other words, the first side surface 62 and the second side surface 64 slope toward each other until the intermediate point 60 is reached.

As also shown in FIG. 1, the elongated handle 32 is symmetrical across a first plane 70 and includes an axial opening 34 for a golf club shaft. The first plane 70 is perpendicular to the front-facing surface 40 and the rear-facing surface 42 and intercepts the longitudinal axis 48 of the elongated handle 32. The elongated handle 32 is further symmetrical across a second plane 72. The second plane 72 is perpendicular to the first side surface 62 and the second side surface 64 and intercepts the longitudinal axis 48 of the elongated handle 32. Consequently, the second plane 72 is orthogonal to the first plane 70. The elongated handle 32 generally includes an underlisting and an outer gripping surface 33, which cooperate to provide its three-dimensional structure. The outer gripping surface 33 generally includes a lower durometer than the underlisting, optionally a molded EVA sleeve. In other embodiments, the underlisting and the gripping surface 33 are integrally formed with one another and comprise a unitary putter grip.

Figure 3:
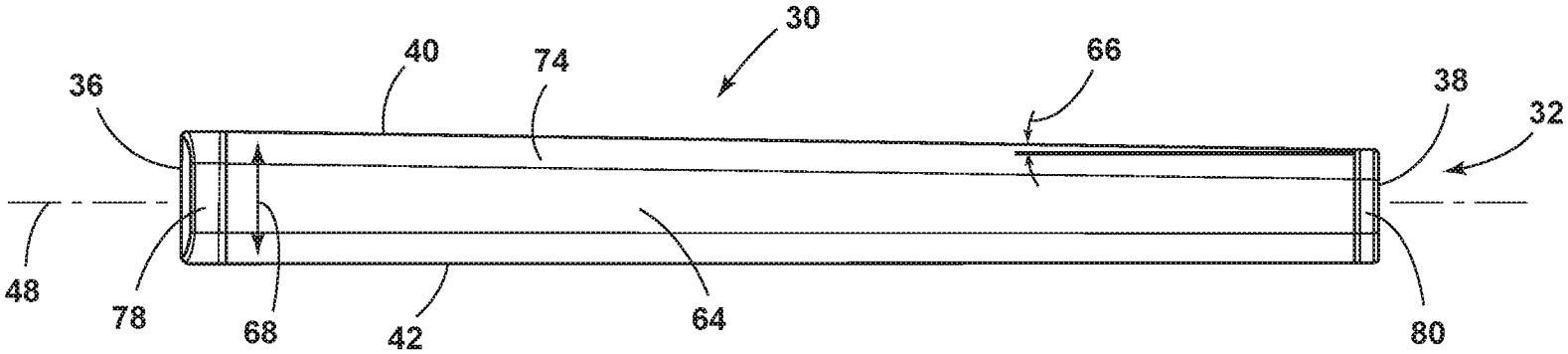
FIG. 3 is second plan view of the putter grip of FIG. 1.
Figure 5:
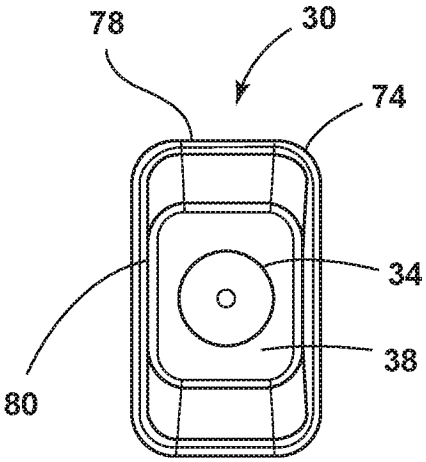
FIG. 5 is a view of the lower end of the putter grip of FIG. 1.

In various embodiments, the first side surface 62 and/or the second side surface 64 is contoured. Optionally, the first side surface 62 and/or the second side surface 64 include a convex contour. Further optionally, the contour may vary as a function of location along the longitudinal axis 48 of the elongated handle 32. For example, a portion of the first side surface 62 proximal to the upper end 36 may conform to a convex contour and a portion of the second side surface 62 proximal to the lower end 38 may be planar. As best shown in FIG. 3, the front-facing surface 40 and the rear-facing surface 42 are planar and form a small angle 66 with the longitudinal axis 48, optionally not more than about five degrees. Accordingly, the distance 68 between the front-facing surface 40 and the rear-facing surface 42 decreases from the upper end 36 to the lower end 38. In other embodiments, the front facing surface 40 and the rear-facing surface 42 are both planar and parallel to each other along their respective lengths.

The elongated handle 32 includes a generally uniform cross-section when taken perpendicular to the longitudinal axis 48. The cross-section includes rounded corners 74 and has a generally rectangular shape in the illustrated embodiment. As discussed below, the cross-section can conform to various other shapes in other embodiments. The dimensions of the cross-section vary as a function of location along the longitudinal axis 48 of the elongated handle 32, while generally preserving its cross-sectional shape as rectangle. Optionally, the shape of the cross-section varies as a function of location along the longitudinal axis 48 of the elongated handle 32.

Figure 4:
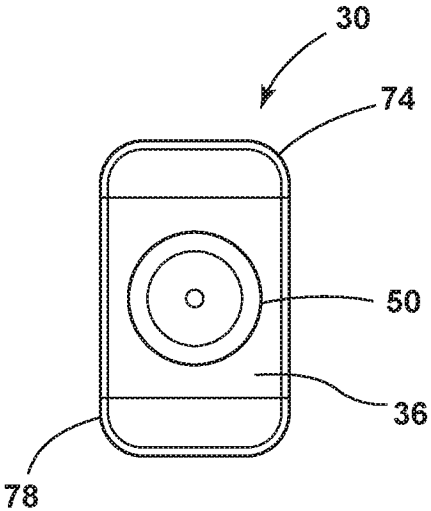
FIG. 4 is a view of the upper end of the putter grip of FIG. 1.
Figure 7:
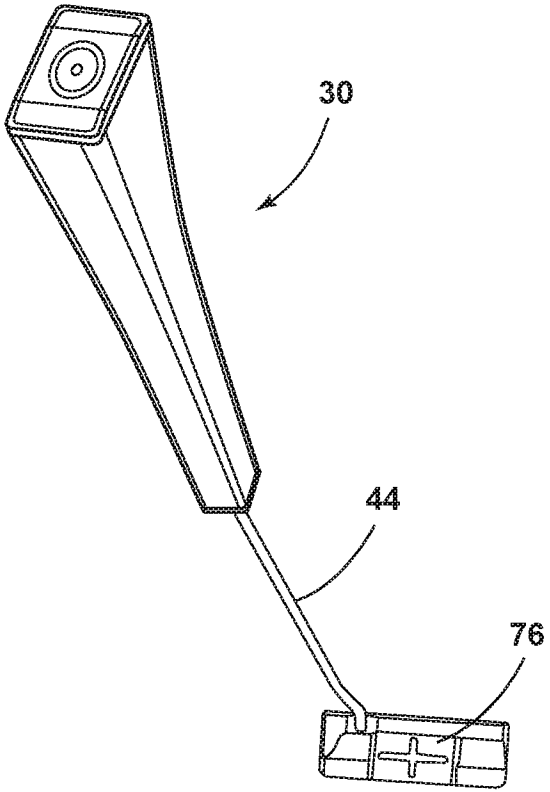
FIG. 7 illustrates the putter grip of FIG. 1 installed in a second orientation.
Figure 6:
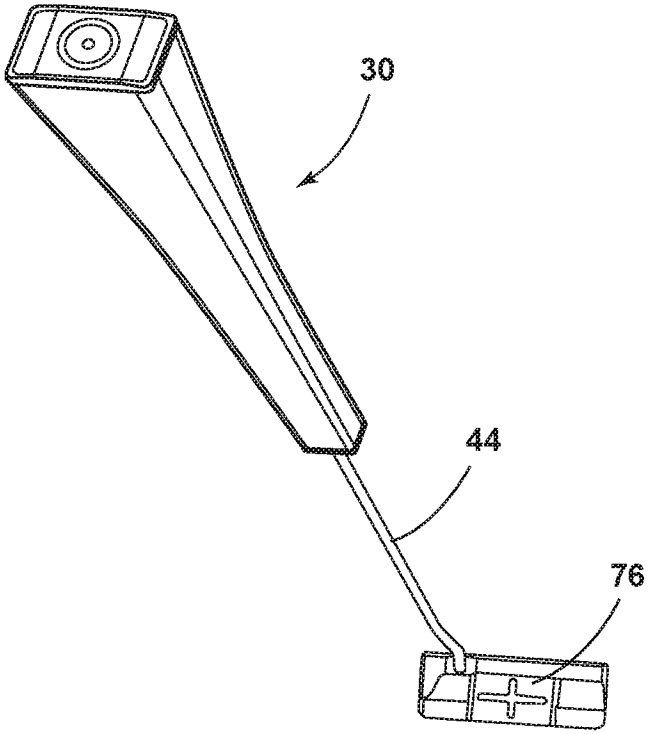
FIG. 6 illustrates the putter grip of FIG. 1 installed in a first orientation.
Figure 8:
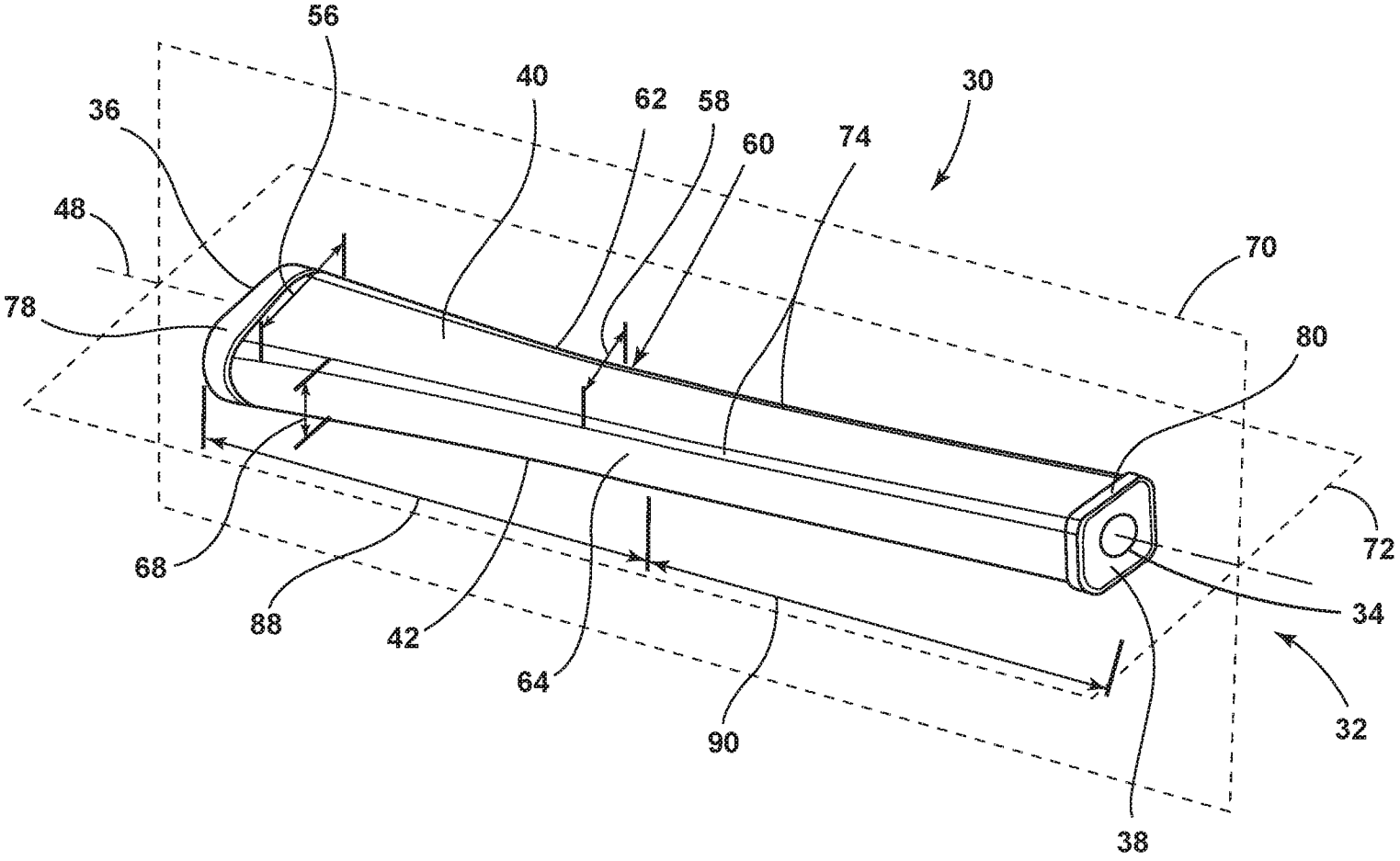
FIG. 8 is a perspective view of a second embodiment of the putter grip.
Figure 9:
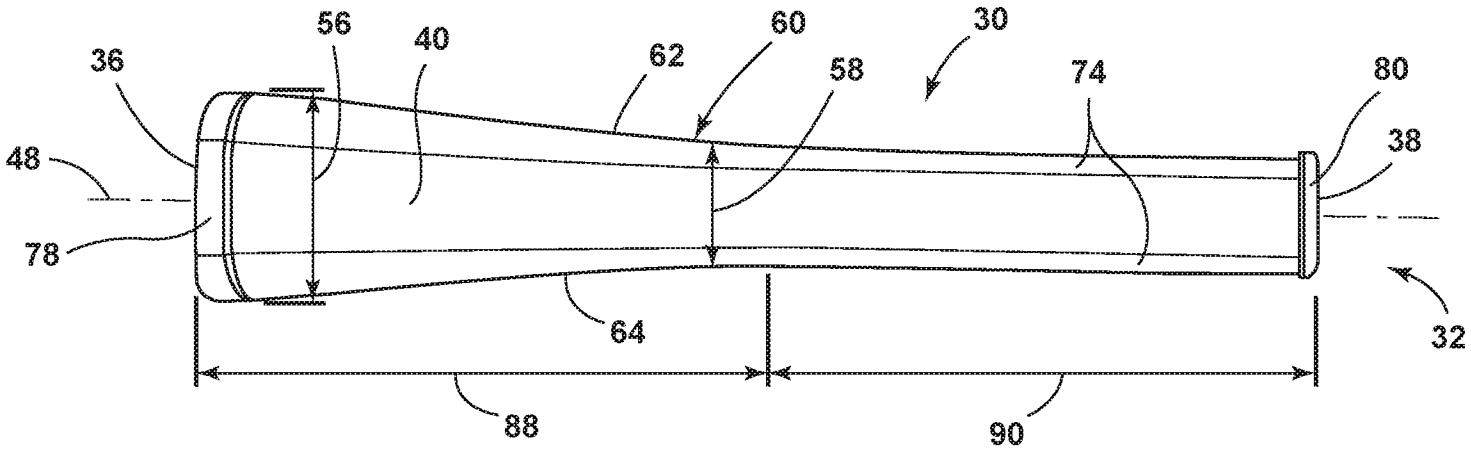
FIG. 9 is a first plan view of the putter grip of FIG. 8.
Figure 10:
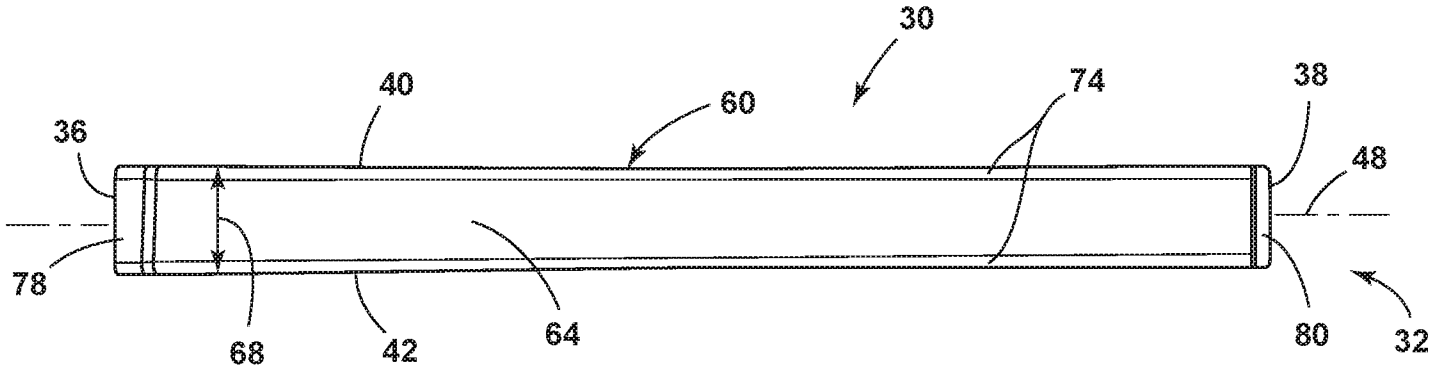
FIG. 10 is a second plan view of the putter grip of FIG. 8.
Figure 12:
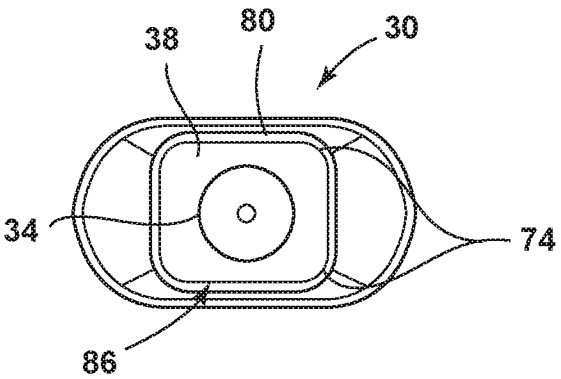
FIG. 12 is a view of the lower end of the putter grip of FIG. 8.
Figure 11:
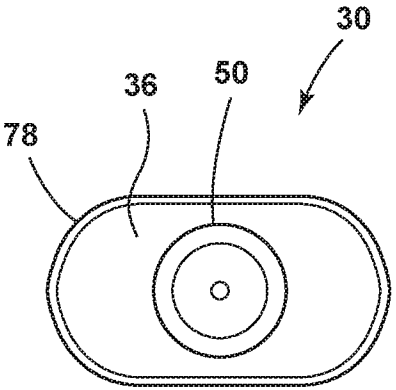
FIG. 11 is a view of the upper end of the putter grip of FIG. 8.
Figure 13:
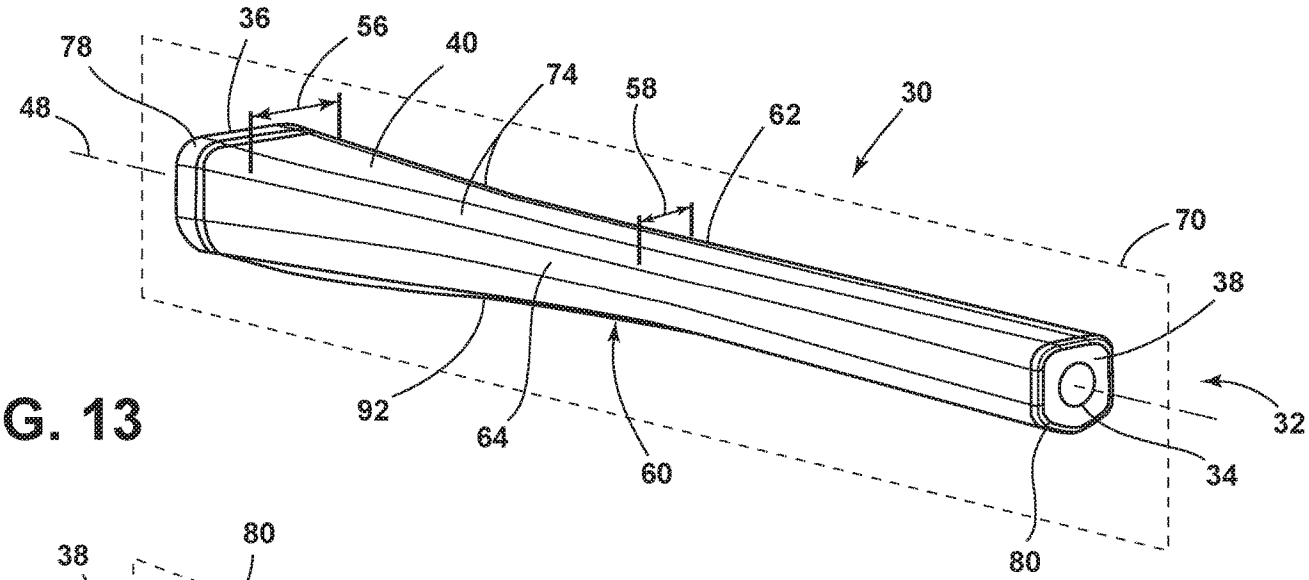
FIG. 13 is a first perspective view of a third embodiment of the putter grip.
Figure 14:
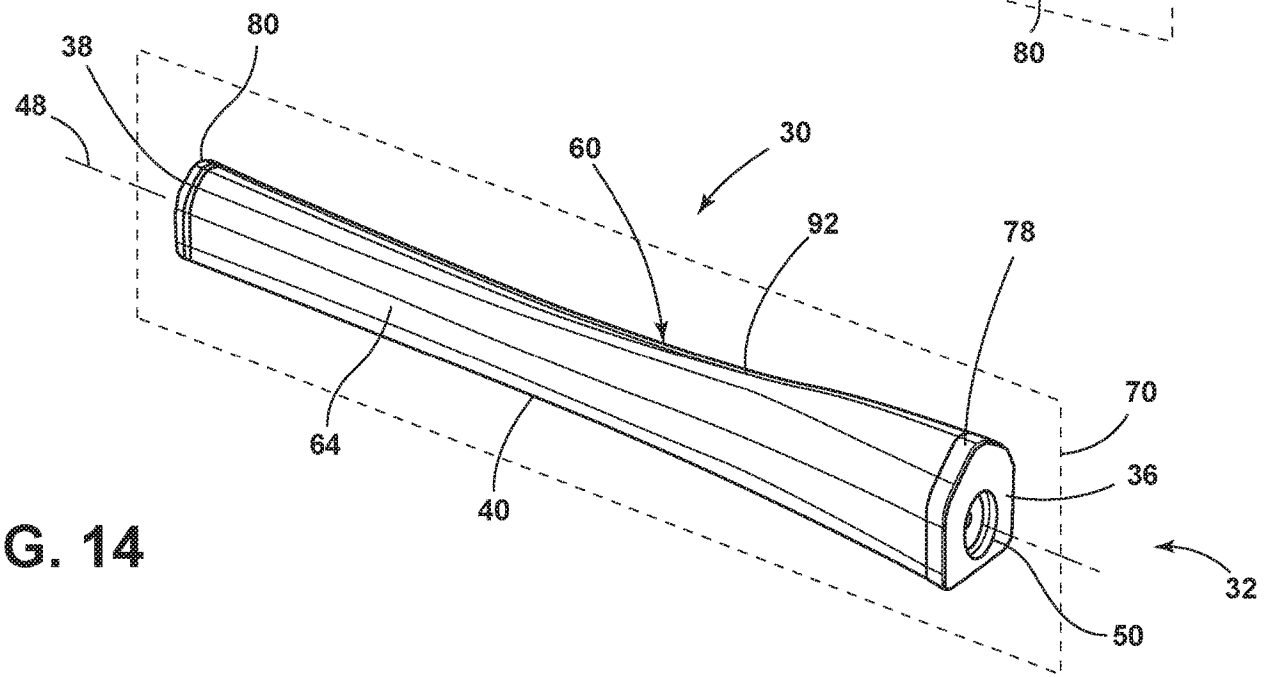
FIG. 14 is a second perspective view of a third embodiment of the putter grip.
Figure 15:
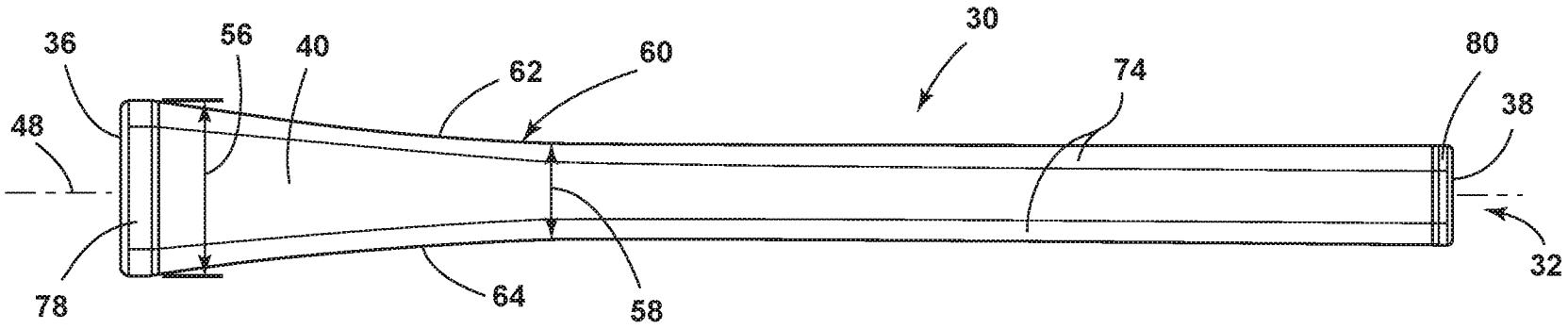
FIG. 15 is a first plan view of the putter grip of FIG. 13.
Figure 16:
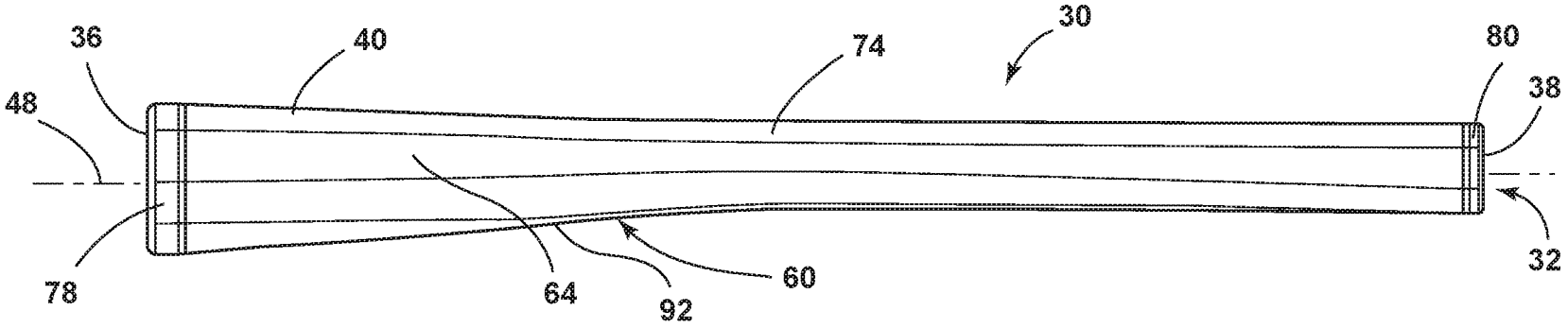
FIG. 16 is a second plan view of the putter grip of FIG. 13.

As noted above, the elongated handle 32 includes an underlisting, the underlisting having an upper peripheral flange 78 and a lower peripheral flange 80, with the outer gripping surface 33 extending therebetween. As shown in FIG. 4, the upper end 36 defines an upper aperture 50 for an end cap comprising a sensor or other device. The putter grip 30 may be assembled to a golf club shaft 44 in a variety of orientations with respect to a golf club head 76. As shown in FIG. 6 for example, the flared upper portion of the elongated handle 32 can align with the toe and heel of the putter head 76. As alternatively shown in FIG. 7, the flared upper portion of the elongated handle 32 can align with the striking face of the putter head 76. In each orientation, the putter grip 30 helps maintain square shoulders during execution of a putter swing.

Referring to FIGS. 8-12, wherein like numerals indicate corresponding parts throughout the several views, a second embodiment of the putter grip 30 is illustrated. The second embodiment of the putter grip 30 differs from the first embodiment of the putter grip 30 primarily with regard to a cross-section(s) defined along a length of the elongated handle 32 and taken perpendicular to the longitudinal axis 48. In particular, the elongated handle 32 of the second embodiment includes a first cross-section and a second cross section perpendicular to the longitudinal axis 48. The first cross-section defines a first shape and the second cross section defines a second shape. The elongated handle 32 defines the first cross-section along a first length 88 of the elongated handle 32 and the elongated handle 32 defines the second cross-section along a second length 90 of the elongated handle 32. Optionally, the sum of the first length 88 and the second length 90 is equivalent to a distance between the upper end 36 and the lower end 38. Optionally, the first length 88 and the second length 90 meet at the intermediate point 60.

The second cross-section is different in shape and dimension from the first cross section. The first shape includes two planar surfaces 40, 42 disposed opposite one another and two convex surfaces 62, 64 disposed opposite one another. The second shape is rectangular and includes rounded edges 74. The dimensionality of the first shape varies as a function of distance from the upper end 36 measured along the longitudinal axis 48. Optionally, the elongated handle 32 includes a transition length (not shown) disposed between the first length 88 and the second length 90. The elongated handle 32 includes along the transition length thereof cross-sections representing transitions between the first shape and the second shape. The two convex surfaces 62, 64 are defined by the first side surface 62 and the second side surface 64, respectively, and the two planar surfaces 40, 42 are defined by the front-facing surface 40 and the rear-facing surface 42, respectively. In various embodiments, the first shape may be any of various shapes and the second shape may be any of various other shapes; however, the first shape and the second shape are distinct from one another in this embodiment.

Referring to FIGS. 13-18, wherein like numerals indicate corresponding parts throughout the several views, a third embodiment of the putter grip 30 is illustrated. The third embodiment of the putter grip 30 differs from the first and second embodiments of the putter grip 30 discussed above primarily with regard to a cross-section(s) along a length of the elongated handle 32 taken perpendicular to the longitudinal axis 48. The cross section conforms to an irregular pentagon (shown in FIGS. 17-18) with at least one side 94 longer than one of the other sides. The longer side 94 sides is defined by the front-facing surface 40, which is sufficiently wide to serve as a point of attachment for left and right thumbs. The shape of the cross-section is generally constant throughout a length of the elongated handle 32 running from the upper end 36 to the lower end 38; however, the dimensionality of the cross-section varies as a function of position along the longitudinal axis 48 such that the dimensions of a cross-section more proximal to the lower end 38 are generally smaller than corresponding dimensions of a cross-section more proximal to the upper end 36. The cross-section also includes rounded edges 74.

Figure 18:
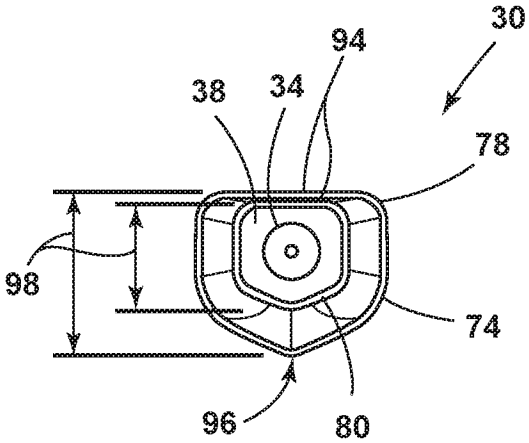
FIG. 18 is a view of the lower end of the putter grip of FIG. 13.
Figure 17:
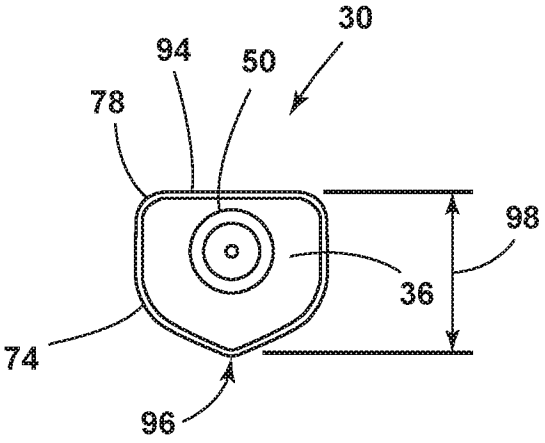
FIG. 17 is a view of the upper end of the putter grip of FIG. 13.
Figure 19:
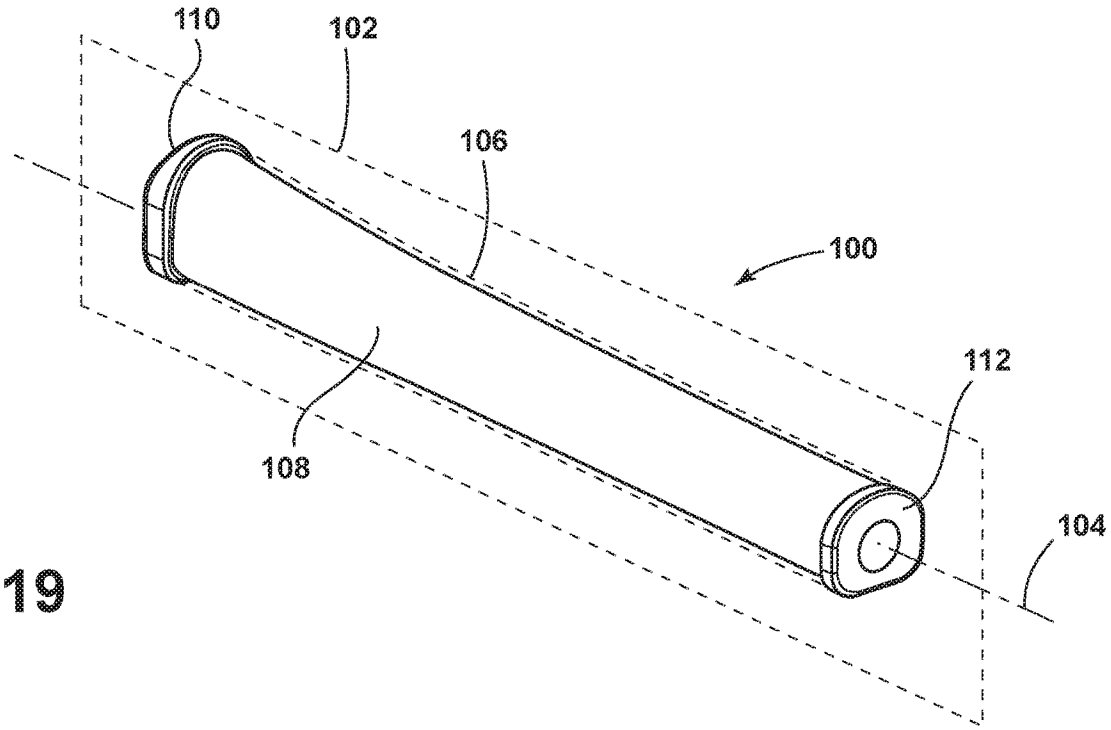
FIG. 19 is a first perspective view of a fourth embodiment of the putter grip.
Figure 20:
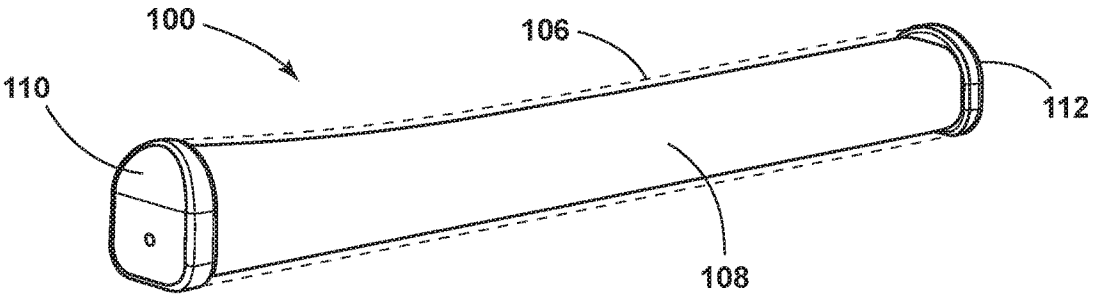
FIG. 20 is a second perspective view of the putter grip of FIG. 19.

As also shown in FIGS. 17-18, the cross-section includes a vertex 96 opposite the planar front-facing surface 40. The vertex 96 provide a raised point of contact for one's fingers, and the vertex 96 and the front-facing surface 40 are separated by a distance 98. The distance 98 is at its greatest at the upper end 36 and is at its smallest at the lower end 38. The vertex 96 conforms to a contour until the distance 98 reaches its minimum at a point proximal to the intermediate point 60. The contour can include an inflection point 92. While described as an irregular pentagon, other cross-sectional shapes can be used in other embodiments, including ovals, circles, and polygons for example. Further, the cross-sectional shape along the upper portion of the elongated handle 32 can differ from the cross-sectional shape along the lower portion of the elongated handle 32 as described above in connection with the second embodiment.

A fourth embodiment of the putter grip is illustrated in FIGS. 19-25 and generally designated 100. The putter grip 100 differs from the embodiments described above in that the putter grip 100 includes only a single-sided pistol taper. Consequently, the putter grip 100 is symmetrical about a single plane of symmetry 102, the plane of symmetry 102 intersecting its longitudinal axis 104. As discussed below, the putter grip 100 transitions from a maximum front-to-back width at an upper end thereof to a minimum front-to-back width at an intermediate point thereof, the minimum width continuing to a lower end thereof.

More specifically, the putter grip 100 includes an outer covering 106 (shown in phantom in FIGS. 19-20) and an underlisting 108. The outer covering 106 generally conforms to the shape of the underlisting 108. The outer covering 106 may be textured to provide a gripping surface, and can be formed of polyurethane for example. The outer covering may be molded directly onto the underlisting or may be manufactured separately and secured to the underlisting. Further optionally, the outer covering and the underlisting may be integrally formed with one another. The underlisting 108 is generally rectangular in cross-sectional shape at the lower end thereof and has a single-sided pistol taper at the upper end thereof, with a smooth transition therebetween. The underlisting 108 also includes an upper end cap 110 and a lower end cap 112.

Figure 21:
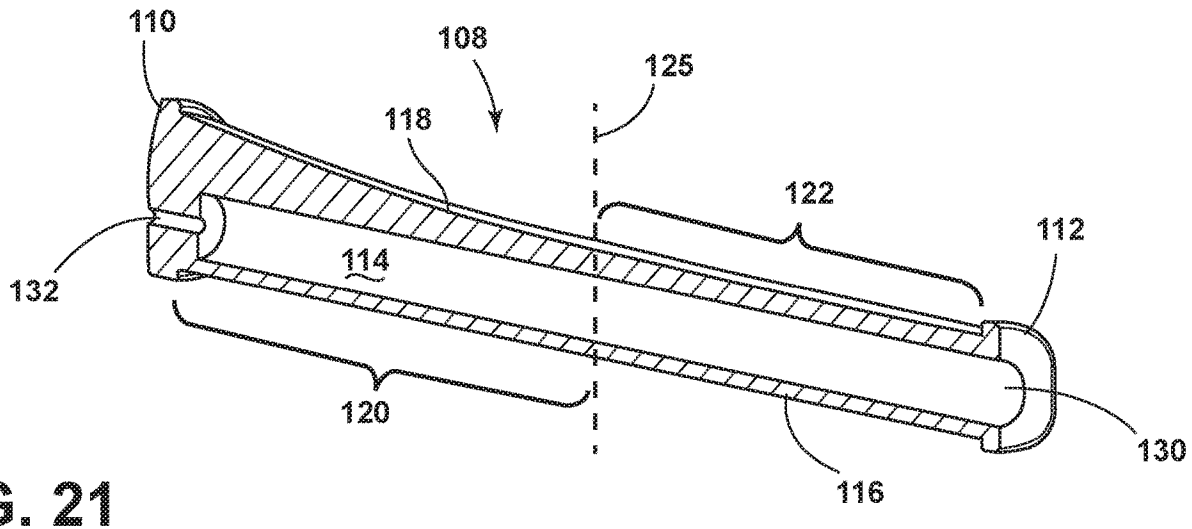
FIG. 21 is a cross-sectional view of the putter grip of FIG. 19.
Figure 22:
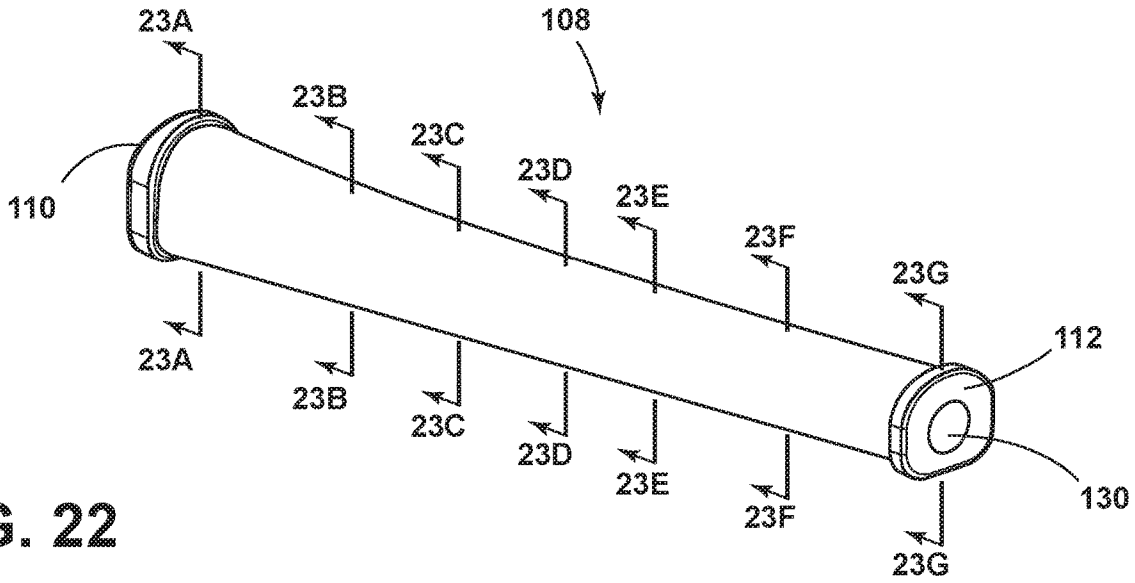
FIG. 22 is a further perspective view of the putter grip of FIG. 19.
Figure 23A:
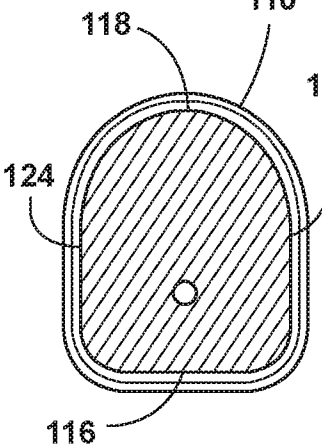
FIGS. 23A-23G are cross-sectional views of the putter grip of FIG. 19 at various planes as shown in FIG. 22.
Figure 23B:
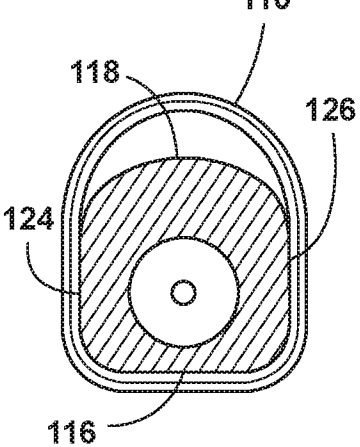
Figure 23C:
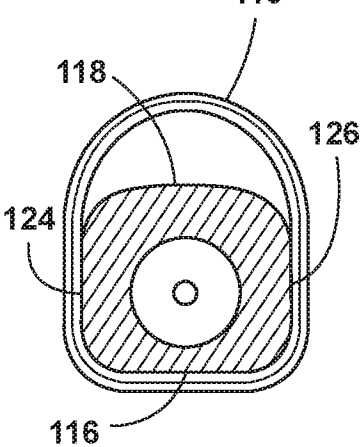
Figure 23D:
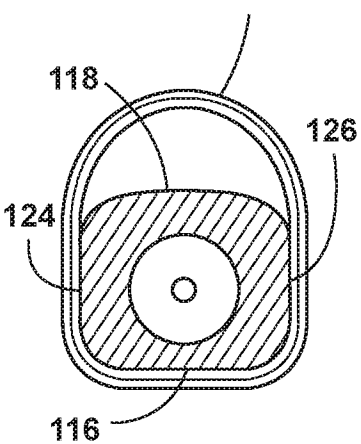
Figure 23E:
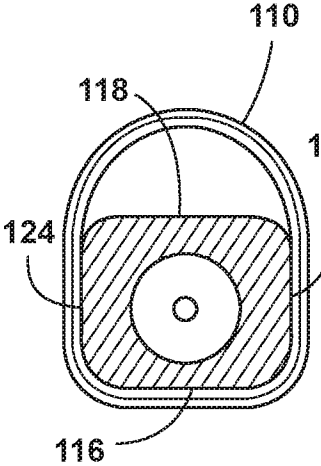
Figure 23F:
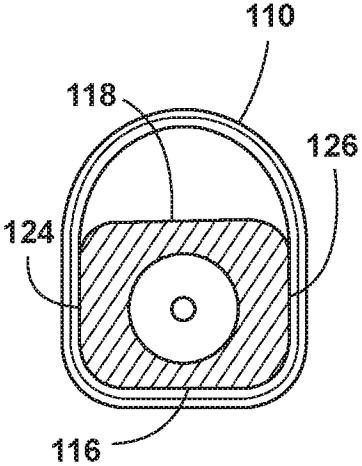
Figure 23G:
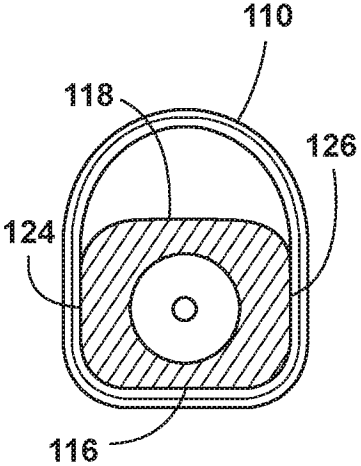
Figure 24:
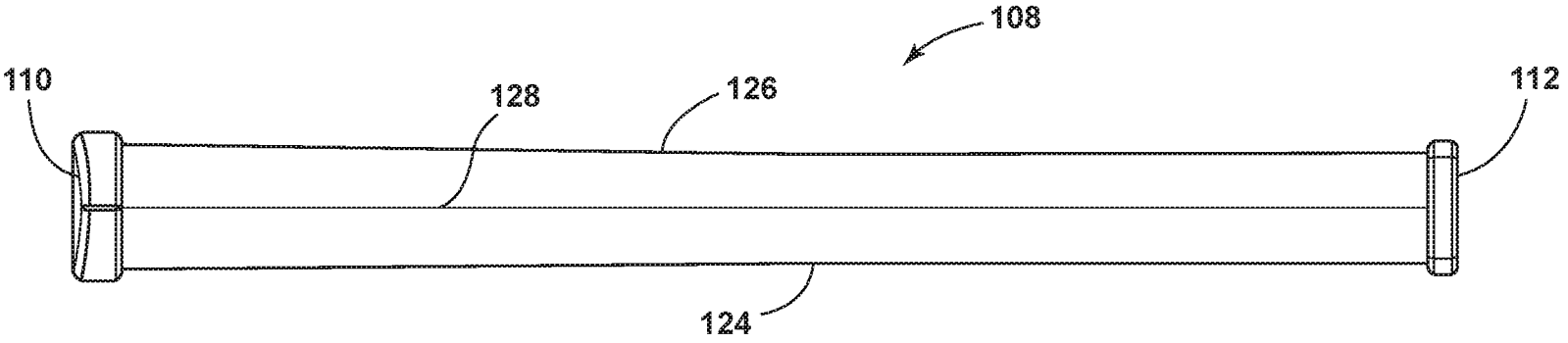
FIG. 24 is a plan view of the putter grip of FIG. 19 including a reminder element or a vertex along the rear-facing surface of the underlisting.
Figure 25:
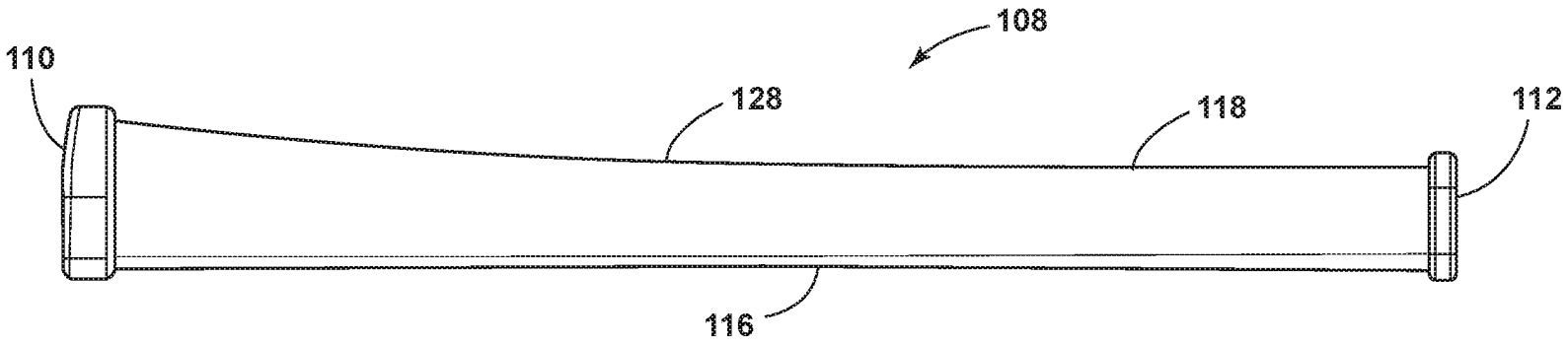
FIG. 25 is a side elevation view of the putter grip of FIG. 24.

Referring to FIG. 21-22, the underlisting 108 is shown in greater detail. The underlisting 108 is a generally hollow structure having a cavity 114 that extends substantially the entire length of the underlisting, but terminates short of the upper end cap 110. The cavity 114 has a generally uniform cross-section through its length for receiving a golf club shaft. The underlisting 108 is further defined by a generally planar front-facing surface 116. In one exemplary embodiment, the width of the front-facing surface 116 tapers slightly. Similarly, the rear-facing surface 118, opposite the front-facing surface 116, is also defined by a side-to-side width that is uniform or that is slightly tapered. In an upper portion 120 of the underlisting, the rear-facing surface 118 is sloped relative to and toward the front-facing surface 116. In the lower portion 122 of the underlisting, the rear-facing surface 118 is generally parallel to the front-facing surface 116 in a lower portion 122 of the underlisting.

Referring to FIGS. 23A-23G, the first and second side surfaces 124,126 generally mirror each other throughout the length of the underlisting, gradually shortening until an intermediate point 125 is reached. The front-facing surface 116 is generally planar throughout its length. The rear-facing surface 118 in the upper portion 120 of the underlisting 108 is contoured to correspond to the contour of the upper end cap 110. The rear-facing surface 118 in the lower portion 122 of the underlisting 108 is generally flat with rounded or beveled edges. As optionally shown in FIGS. 24-25, the rear-facing surface 118 can include a reminder element 128, similar to the vertex 92 of FIG. 14, along at least a portion of the bottom surface of the underlisting or outer covering. In other embodiments, the reminder element 128 does not extend into the lower portion 120, which instead flattens out after the transition point 125 to form a rectangular cross-sectional shape in cooperation with the planar front-facing surface 116 of the underlisting.

The golf grip 100 is assembled to a golf shaft by introducing the golf shaft through an opening 130 in the lower end cap 112 and into the cavity 114 formed within the underlisting 108. The golf grip 100 may be rotated to position the golf grip to a desired position with respect to a club face. Air may be expelled through the opening 132 in the upper end cap 110 to facilitate engagement of the golf shaft into the cavity 114. Once positioned, the golf grip may be fixed to the golf shaft by any method, including the use of an upper clamp assembly and a lower clamp assembly, whether now known or hereinafter developed.

Figure 26:
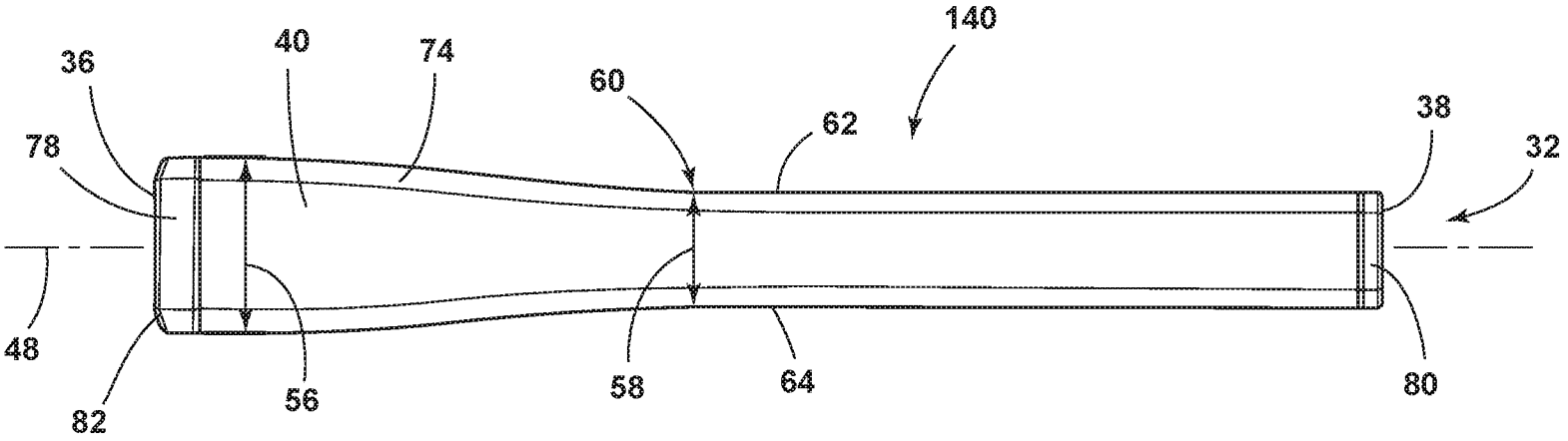
FIG. 26 is a first plan view of a fifth embodiment of a putter grip.
Figure 27:
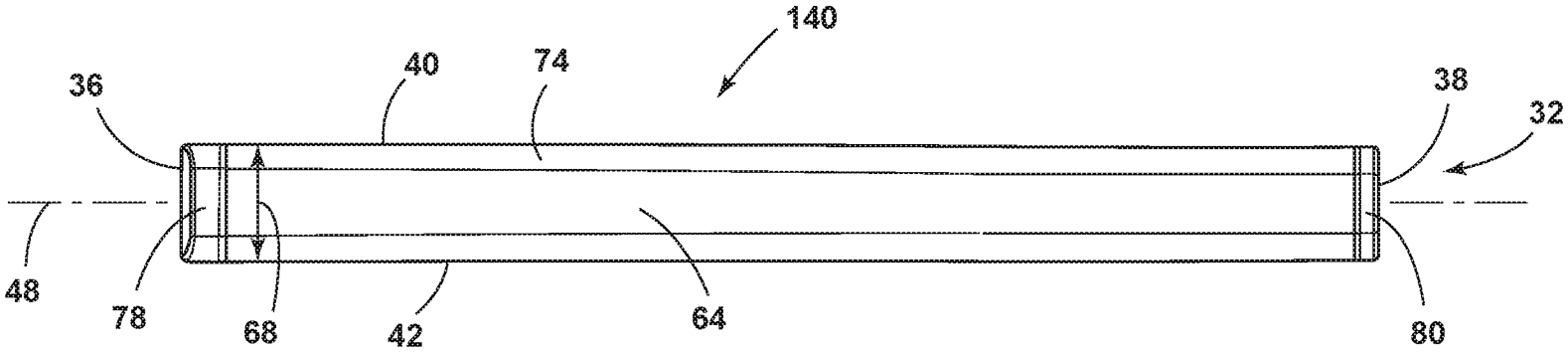
FIG. 27 is a second plan view of the putter grip of FIG. 26.

A fifth embodiment of the putter grip is illustrated in FIGS. 26-27 and generally designated 140. The putter grip 140 of FIGS. 26-27 differs from the first embodiment described above in connection with FIGS. 1-7 in that the putter grip 140 includes a minimal taper, e.g., having an angle-of-taper of less than twenty degrees, further optionally less than fifteen degrees. As used herein, "angle-of-taper" means the angle defined between the longitudinal axis 48 and the sloped side surface 62 or 64. To achieve this minimal taper, the minimum side-to-side width 58 of the elongated handle 32 is greater than 50% of the maximum side-to-side width 56, where the "side-to-side width" is taken from a first side 60 to a second side 62, perpendicular to the longitudinal axis 48 of the elongated handle 32. For example, the minimum width 58 can be greater than 90% of the maximum width 56. As the intermediate point 60 moves away from the upper end 36, the minimum width 58 can comprise a lesser fraction of the maximum width 56 and the elongated handle can still define an angle-of-taper less than twenty degrees. Further by example, the minimum width 58 can be greater than 90% of the maximum width 56 while maintaining an angle-of-taper of less than twenty degrees.

The putter grip 140 is otherwise functionally and structurally similar to the putter grip 30 of FIGS. 1-7. As best shown in FIG. 27, the front-facing surface 40 and the rear-facing surface 42 are planar and are parallel to each other along their respective lengths. The putter grip 140 is symmetrical about a single plane of symmetry intersecting its longitudinal axis 48, the putter grip 140 having a maximum side-to-side width 56 at an upper end thereof and a minimum side-to-side width 58 at an intermediate point thereof, the minimum width continuing to a lower end thereof. As discussed above, the first side surface 62 and the second side surface 64 slope toward each other along the longitudinal axis 48 of the elongated handle 32 such that a distance between the first side surface 62 and the second side surface 64 decreases in a continuous manner with constant slope, until the intermediate point 60 is reached.

Figure 28:
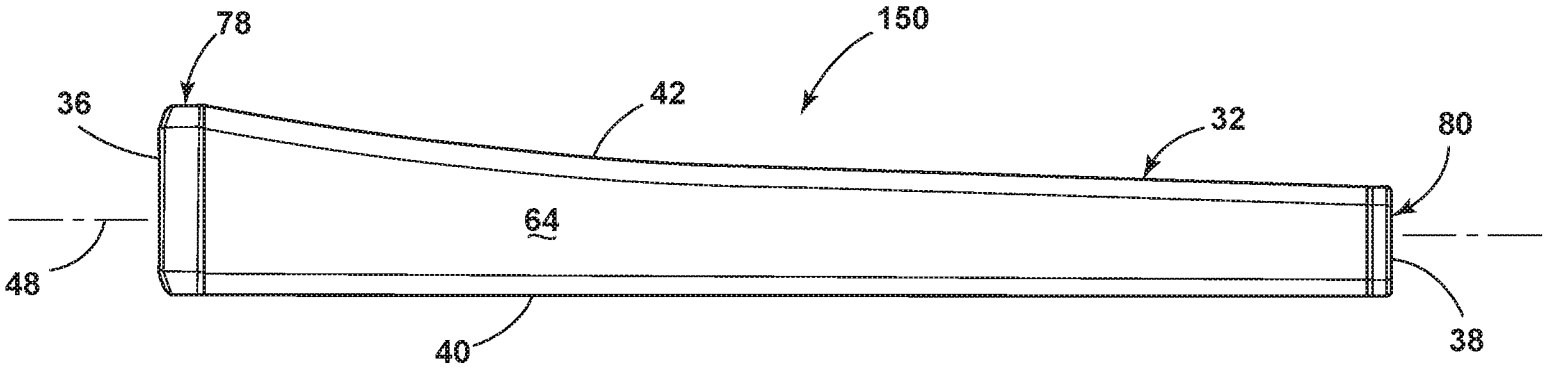
FIG. 28 is a first plan view of a sixth embodiment of a putter grip.
Figure 29:
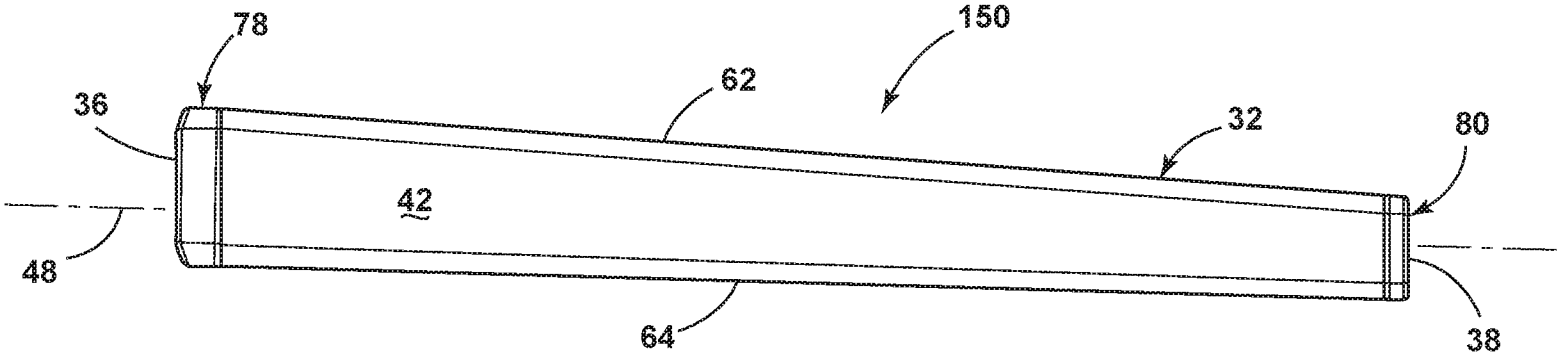
FIG. 29 is a second plan view of the putter grip of FIG. 28.
Figure 31:
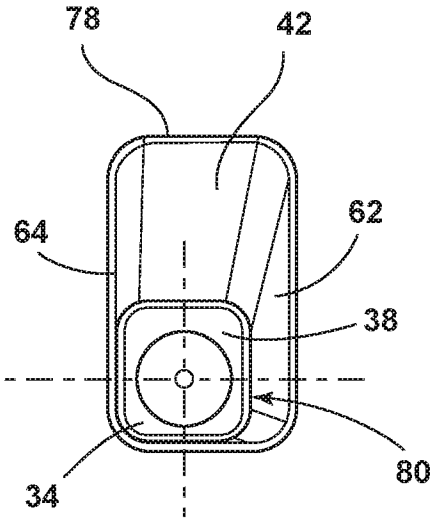
FIG. 31 is a view of the lower end of the putter grip of FIG. 28.
Figure 30:
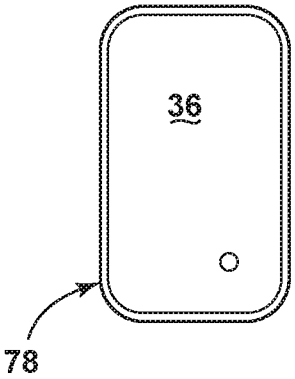
FIG. 30 is a view of the upper end of the putter grip of FIG. 28.

A sixth embodiment of the putter grip is illustrated in FIGS. 28-31 and generally designated 150. The putter grip 150 differs from the embodiments described above in that a portion of the putter grip 150 is completely asymmetrical about its longitudinal axis 48. In particular, the putter grip 150 includes a front-facing surface 40 that adheres to a different contour than a rear-facing surface 42 and includes a first side surface 62 that adheres to a different contour than a second side-surface 64. As shown in FIG. 28 for example, the putter grip 150 includes a rear-facing surface 42 that slopes upwardly toward the upper end 36 of the elongated handle 32 along an upper portion thereof. The front-facing surface 40, by contrast, is planar along its entire length. As shown in FIG. 29, the first side surface 62 is angled relative to the longitudinal axis 48 along length of the elongated handle 32. The second side-surface, by contrast, is planar along its entire length. Because each surface adheres to a different contour than its opposite surface, at least a portion of the putter grip 150 is asymmetrical when viewed from any perspective about the longitudinal axis 48. The asymmetry of the upper portion of the putter grip 150 is perhaps best shown in FIG. 31. As shown, the rear-facing surface 42 slopes downwardly from the upper end 36 of the putter grip while the front-facing surface 40 remains planar. As also shown, the first side surface 62 slopes inwardly from the upper end 36 of the putter grip while the second side-surface 64 remains planar. As a result, the lower end cap 80 is offset with respect to the upper end cap 78 in the front-to-rear direction and in the side-to-side direction, while the elongated handle generally retains a rectangular cross-section throughout its length. In other embodiments, the lower portion of the putter grip 150 is symmetrical about a first plane perpendicular to the front and rear facing surfaces 40, 42 and a second plane that is perpendicular to the first and second side surfaces 62, 64. In still other embodiments, the putter grip 150 can be asymmetrical along a lower portion thereof and symmetrical along an upper portion thereof.

The above description is that of current embodiments of the invention. While certain features of the putter grip are functional, they can be implemented in different aesthetic configurations. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular.

The invention claimed is:

1. A putter grip comprising:

an elongated handle having an upper end, a lower end, a front-facing and a rear-facing surface, the front-facing surface extending opposite of the rear-facing surface; and an axial opening defined within the elongated handle for a putter shaft, the axial opening being centered along a longitudinal axis of the elongated handle, wherein the elongated handle includes an upper portion that transitions from a maximum side-to-side width at the upper end of the elongated handle to a minimum side-to-side width at an intermediate point along the elongated handle, the upper portion including a first side surface and a second side surface, the first side surface and the second side surface sloping toward each other, being joined to the front-facing surface and the rear-facing surface, wherein the elongated handle further includes a lower portion that is a continuous extension of the upper portion, wherein the elongated handle defines a first cross-sectional shape along the upper portion of the elongated handle and wherein the elongated handle defines a second cross-sectional shape along the lower portion of the elongated handle, wherein the first cross-sectional shape comprises rounded side portions and wherein the second cross-sectional shape comprises a rectangle.

2. The putter grip of claim 1, wherein the elongated handle is symmetrical across a first plane that bisects the elongated handle, the first plane being perpendicular to the front-facing surface and the rear-facing surface.

3. The putter grip of claim 2, wherein the elongated handle is symmetrical across a second plane that is orthogonal to the first plane.

4. The putter grip of claim 1, wherein the first side surface and the second side surface are externally convex along the upper portion of the elongated handle.

5. The putter grip of claim 1, wherein the front-facing surface and the rear-facing surface are parallel to each other along the length of the elongated handle.

6. The putter grip of claim 1, wherein the elongated handle is assembled to a golf club shaft.

7. A putter grip comprising:

an elongated handle including an upper end and a lower end; and an axial opening centered along a longitudinal axis of the elongated handle, wherein the elongated handle includes a planar front-facing surface along a length thereof, the elongated handle further including an upper portion that transitions from a maximum width at the upper end of the elongated handle to a minimum width at an intermediate point between the upper end and the lower end of the elongated handle, the upper portion including a first side surface and a second side surface that slope toward each other and that are joined to the front-facing surface, wherein the elongated handle is symmetrical across a first plane that is perpendicular to the front-facing surface and that intersects the longitudinal axis of the elongated handle, wherein the elongated handle defines a first cross-sectional shape along the upper portion of the elongated handle and wherein the elongated handle defines a second cross-sectional shape along the lower portion of the elongated handle, wherein the first cross-sectional shape comprises rounded side portions and wherein the second cross-sectional shape comprises a rectangle.

8. The putter grip of claim 7, wherein the elongated handle includes a rear-facing surface opposite of the front-facing surface, the rear-facing surface being planar along its entire length.

9. The putter grip of claim 7, wherein the first cross-sectional shape varies in dimension as a function of its location along the longitudinal axis of the elongated handle.

10. A putter grip, comprising:

an elongated handle having an upper end and a lower end;

an axial opening defined within the lower end of the elongated handle for a putter shaft; and a planar front-facing surface defined by the elongated handle and running from the upper end to the lower end, wherein the elongated handle includes an upper portion that transitions from a maximum width at the upper end of the elongated handle to a minimum width at an intermediate point along the elongated handle, the upper portion including a first side surface and a second side surface that slope toward each other and that are joined to the front-facing surface, wherein the minimum width at the intermediate point of the elongated handle is equal to a width of the lower end of the elongated handle, wherein the elongated handle is symmetrical across a first plane perpendicular to the first side and intersecting the longitudinal axis of the elongated handle, wherein the elongated handle defines a first cross-sectional shape along the upper portion of the elongated handle and wherein the elongated handle defines a second cross-sectional shape along the lower portion of the elongated handle, wherein the first cross-sectional shape comprises rounded side portions and wherein the second cross-sectional shape comprises a rectangle.

11. The golf club grip of claim 10, wherein the elongated handle is symmetrical across a second plane that is orthogonal to the first plane.

12. The putter grip of claim 10, further including a planar rear-facing surface opposite of the planar front-facing surface and connected to the first side surface and the second side surface.

* * * * *